US012576321B2

(12) United States Patent
Hunt et al.

(10) Patent No.: US 12,576,321 B2
(45) Date of Patent: Mar. 17, 2026

(54) BALL BAT WITH SHOCK ATTENUATING HANDLE

(71) Applicant: EASTON DIAMOND SPORTS, LLC, Thousand Oaks, CA (US)

(72) Inventors: Linda Hunt, Simi Valley, CA (US); Ian Montgomery, Simi Valley, CA (US); Dewey Chauvin, Simi Valley, CA (US); Frederic St-Laurent, Oak Park, CA (US)

(73) Assignee: EASTON DIAMOND SPORTS, LLC, St. Louis, MO (US)

( * ) Notice: Subject to any disclaimer, the term of this patent is extended or adjusted under 35 U.S.C. 154(b) by 1181 days.

(21) Appl. No.: 16/503,281

(22) Filed: Jul. 3, 2019

(65) Prior Publication Data

US 2019/0321705 A1 Oct. 24, 2019

Related U.S. Application Data

(63) Continuation of application No. 15/815,423, filed on Nov. 16, 2017, now Pat. No. 10,384,106.

(51) Int. Cl.
*A63B 60/54* (2015.01)
*A63B 1/00* (2006.01)
(Continued)

(52) U.S. Cl.
CPC ..... *A63B 60/54* (2015.10); *A63B 1/00* (2013.01); *A63B 59/51* (2015.10); *A63B 59/54* (2015.10);
(Continued)

(58) Field of Classification Search
CPC ..... A63B 60/54; A63B 59/51; A63B 59/54; A63B 59/58
(Continued)

(56) References Cited

U.S. PATENT DOCUMENTS 537,927 A 4/1895 Kennedy
546,540 A 9/1895 Kennedy
(Continued)

FOREIGN PATENT DOCUMENTS

JP H07163693 A 6/1995

OTHER PUBLICATIONS https://www.3mcanada.ca/3M/en_CA/p/d/b40066487/ (Year: 2020).*
(Continued)

*Primary Examiner* — Jeffrey S Vanderveen
(74) *Attorney, Agent, or Firm* — PERKINS COIE LLP

(57) ABSTRACT

A ball bat includes a first bat portion (such as a barrel portion) and a second bat portion (such as a handle). The portions may be spaced apart along the bat's longitudinal axis. A joint connects the first and second bat portions. The joint may be positioned at or near, or centered about, a location of maximum vibration, such as an antinode of the bat. The joint may include a filler material (such as an elastomeric material) at least partially surrounding a rod element. The filler material and the rod element may span a gap between the first and second bat portions. The filler material and the rod element may extend into the first bat portion or the second bat portion. A cover material may be positioned around the filler material. The joint may form a structural link between the bat portions and it may be configured to absorb vibration.

15 Claims, 6 Drawing Sheets

(51) Int. Cl.

| | |
|---|---|
| ***A63B 59/51*** | (2015.01) |
| ***A63B 59/54*** | (2015.01) |
| ***A63B 59/58*** | (2015.01) |
| ***A63B 102/18*** | (2015.01) |

(52) U.S. Cl.
CPC ..... *A63B 59/58* (2015.10); *A63B 2059/581* (2015.10); *A63B 2102/18* (2015.10); *A63B 2209/00* (2013.01); *A63B 2209/02* (2013.01)

(58) Field of Classification Search
USPC ..... 473/564
See application file for complete search history.

(56) References Cited

U.S. PATENT DOCUMENTS

| | | | |
|---|---|---|---|
| 1,026,990 | A | 5/1912 | Matson |
| 1,509,733 | A | 9/1924 | Langford et al. |
| 1,650,183 | A | 11/1927 | Brooks et al. |
| 2,475,927 | A | 7/1949 | Verderber |
| 3,116,926 | A | 1/1964 | Owen et al. |
| 3,830,496 | A | 8/1974 | Reizer |
| 3,861,682 | A | 1/1975 | Fujii |
| 3,876,204 | A | 4/1975 | Moore et al. |
| 3,877,698 | A | 4/1975 | Volpe |
| 3,897,058 | A | 7/1975 | Koch |
| 3,955,816 | A | 5/1976 | Bratt |
| 3,963,239 | A | 6/1976 | Fujii |
| 4,025,377 | A | 5/1977 | Tanikawa |
| 4,032,143 | A | 6/1977 | Mueller et al. |
| 4,056,267 | A | 11/1977 | Krieger |
| 4,113,248 | A | 9/1978 | Yanagioka |
| 4,323,239 | A | 4/1982 | Ishii |
| 4,351,786 | A | 9/1982 | Mueller |
| 4,505,479 | A | 3/1985 | Souders |
| 4,569,521 | A | 2/1986 | Mueller |
| 4,572,508 | A | 2/1986 | You |
| 4,600,193 | A | 7/1986 | Merritt |
| 4,746,117 | A | 5/1988 | Noble et al. |
| 4,834,370 | A | 5/1989 | Noble et al. |
| 4,848,745 | A | 7/1989 | Bohannan et al. |
| 4,898,386 | A | 2/1990 | Anderson et al. |
| 4,951,948 | A | 8/1990 | Peng |
| 4,961,576 | A | 10/1990 | Meredith |
| 5,104,123 | A | 4/1992 | Okitsu et al. |
| 5,114,144 | A | 5/1992 | Baum |
| 5,131,651 | A | 7/1992 | You |
| 5,180,163 | A | 1/1993 | Lanctot et al. |
| 5,219,164 | A | 6/1993 | Peng |
| 5,277,421 | A | 1/1994 | Rewolinski |
| 5,303,917 | A | 4/1994 | Uke |
| D347,671 | S | 6/1994 | Weiss et al. |
| 5,380,003 | A | 1/1995 | Lanctot |
| 5,409,214 | A | 4/1995 | Cook |
| 5,415,398 | A | 5/1995 | Eggiman |
| 5,456,461 | A | 10/1995 | Sullivan |
| 5,511,777 | A | 4/1996 | McNeely |
| 5,516,097 | A | 5/1996 | Huddleston |
| 5,593,158 | A | 1/1997 | Filice et al. |
| 5,674,138 | A | 10/1997 | Nolan |
| 5,676,609 | A | 10/1997 | Mollebaek et al. |
| 5,711,726 | A | 1/1998 | Powers et al. |
| 5,722,908 | A | 3/1998 | Feeney et al. |
| 5,820,438 | A | 10/1998 | Horton |
| 5,833,561 | A | 11/1998 | Kennedy et al. |
| 6,048,283 | A | 4/2000 | Albarelli et al. |
| 6,050,908 | A | 4/2000 | Muhlhausen |
| 6,053,828 | A | 4/2000 | Pitsenberger |
| 6,056,655 | A | 5/2000 | Feeney et al. |
| 6,099,422 | A | 8/2000 | Rappaport et al. |
| 6,173,610 | B1 | 1/2001 | Pace et al. |
| 6,280,353 | B1 | 8/2001 | Brundage et al. |
| 6,287,222 | B1 | 9/2001 | Pitsenberger |
| 6,344,007 | B1 | 2/2002 | Feeney et al. |
| 6,398,675 | B1 | 6/2002 | Eggiman et al. |
| 6,402,634 | B2 | 6/2002 | Lee et al. |
| 6,406,387 | B1 | 6/2002 | Ryan et al. |
| 6,432,006 | B1 | 8/2002 | Tribble |
| 6,482,114 | B1 | 11/2002 | Eggiman et al. |
| 6,485,382 | B1 | 11/2002 | Chen |
| 6,497,631 | B1 | 12/2002 | Fritzke et al. |
| 6,511,392 | B1 | 1/2003 | Chohan |
| 6,547,673 | B2 | 4/2003 | Roark |
| 6,569,042 | B2 | 5/2003 | Lachance et al. |
| 6,612,945 | B1 | 9/2003 | Anderson |
| 6,625,848 | B1 | 9/2003 | Schneider |
| 6,663,517 | B2 | 12/2003 | Buiatti et al. |
| D485,876 | S | 1/2004 | Andrews |
| 6,729,983 | B1 | 5/2004 | Vakili et al. |
| 6,733,404 | B2 | 5/2004 | Fritzke et al. |
| 6,743,127 | B2 | 6/2004 | Eggiman et al. |
| 6,758,771 | B2 | 7/2004 | Tribble et al. |
| 6,761,653 | B1 | 7/2004 | Higginbotham et al. |
| 6,808,464 | B1 | 10/2004 | Nguyen |
| 6,824,482 | B1 | 11/2004 | Tribble |
| 6,872,156 | B2 | 3/2005 | Ogawa et al. |
| 6,878,080 | B2 | 4/2005 | Chang |
| 6,939,237 | B1 | 9/2005 | Voden et al. |
| 6,945,886 | B2 | 9/2005 | Eggiman et al. |
| 7,011,588 | B2 | 3/2006 | Fritzke et al. |
| 7,014,580 | B2 | 3/2006 | Forsythe et al. |
| 7,097,578 | B2 | 8/2006 | Guenther et al. |
| 7,140,248 | B1 | 11/2006 | Brundage |
| 7,140,987 | B2 | 11/2006 | Davis et al. |
| 7,140,988 | B1 | 11/2006 | Hinman et al. |
| 7,147,580 | B2 | 12/2006 | Nutter et al. |
| 7,163,475 | B2 | 1/2007 | Giannetti |
| 7,171,697 | B2 | 2/2007 | Vito et al. |
| 7,201,679 | B2 | 4/2007 | Nguyen et al. |
| 7,235,024 | B2 | 6/2007 | Lefebvre et al. |
| 7,297,077 | B1 | 11/2007 | Battaglino |
| 7,320,653 | B2 | 1/2008 | Fitzgerald et al. |
| 7,344,461 | B2 | 3/2008 | Van Nguyen |
| 7,377,866 | B2 | 5/2008 | Van Nguyen |
| 7,377,867 | B1 | 5/2008 | Vacek et al. |
| 7,381,141 | B2 | 6/2008 | Van |
| 7,410,433 | B2 | 8/2008 | Guenther et al. |
| 7,419,446 | B2 | 9/2008 | Nguyen et al. |
| 7,442,134 | B2 | 10/2008 | Giannetti et al. |
| 7,442,135 | B2 | 10/2008 | Giannetti et al. |
| 7,534,180 | B1 | 5/2009 | Vacek et al. |
| 7,572,197 | B2 | 8/2009 | Chauvin et al. |
| 7,585,235 | B2 | 9/2009 | Misono et al. |
| 7,704,159 | B1 | 4/2010 | McDonald et al. |
| 7,749,115 | B1 | 7/2010 | Cruz et al. |
| 7,798,926 | B1 | 9/2010 | Hsu et al. |
| 7,837,579 | B2 | 11/2010 | Hughes et al. |
| 7,850,553 | B2 | 12/2010 | Goldsmith et al. |
| 7,862,456 | B2 | 1/2011 | Halko et al. |
| 7,867,114 | B2 | 1/2011 | Sutherland et al. |
| 7,909,705 | B2 | 3/2011 | Andersen et al. |
| 7,942,764 | B2 | 5/2011 | Chung et al. |
| 7,955,200 | B1 | 6/2011 | Cruz et al. |
| 8,052,547 | B2 | 11/2011 | Nusbaum et al. |
| 8,142,382 | B2 | 3/2012 | Falone et al. |
| 8,197,365 | B2 | 6/2012 | Tokieda |
| 8,206,250 | B1 | 6/2012 | Cruz et al. |
| 8,226,505 | B2 | 7/2012 | Burger et al. |
| 8,277,343 | B2 | 10/2012 | Chang |
| 8,297,601 | B2 | 10/2012 | Falone et al. |
| 8,313,397 | B2 | 11/2012 | Watari et al. |
| 8,317,640 | B1 | 11/2012 | Cruz et al. |
| 8,413,262 | B2 | 4/2013 | Falone et al. |
| 8,425,353 | B2 | 4/2013 | Jones et al. |
| 8,449,412 | B2 | 5/2013 | Vander Pol et al. |
| 8,491,423 | B1 | 7/2013 | Biggio et al. |
| 8,512,174 | B2 | 8/2013 | Epling et al. |
| 8,512,175 | B2 | 8/2013 | Epling et al. |
| 8,512,176 | B1 | 8/2013 | Mathew et al. |
| 8,545,966 | B2 | 10/2013 | Falone et al. |
| 8,715,118 | B2 | 5/2014 | Epling et al. |
| D711,989 | S | 8/2014 | Goodwin et al. |
| 8,814,733 | B2 | 8/2014 | Shindome et al. |
| 8,827,846 | B2 | 9/2014 | Shocklee |

(56) References Cited

U.S. PATENT DOCUMENTS

| | | | | |
|---|---|---|---|---|
| 8,894,518 | B2 | 11/2014 | Chung | |
| 8,998,753 | B2 | 4/2015 | Tinti | |
| 8,998,754 | B2 | 4/2015 | Mackey et al. | |
| 9,101,810 | B2 | 8/2015 | Carlson et al. | |
| 9,115,833 | B2 | 8/2015 | Crompton et al. | |
| 9,149,697 | B2 | 10/2015 | Epling et al. | |
| 9,242,156 | B2 | 1/2016 | Flood et al. | |
| 9,265,999 | B2 | 2/2016 | Falone et al. | |
| 9,308,424 | B2 | 4/2016 | Thurman et al. | |
| 9,387,382 | B2 | 7/2016 | Long | |
| 9,457,248 | B2 | 10/2016 | Long et al. | |
| 9,486,680 | B2 | 11/2016 | Burger et al. | |
| 9,511,267 | B2 | 12/2016 | Thurman et al. | |
| 9,669,277 | B1 | 6/2017 | Haas et al. | |
| 10,245,488 | B1 * | 4/2019 | Kays | A63B 59/50 |
| 2003/0148836 | A1 | 8/2003 | Falone et al. | |
| 2003/0195066 | A1 * | 10/2003 | Eggiman | A63B 60/54 473/567 |
| 2004/0048701 | A1 * | 3/2004 | Falone | B25G 1/01 473/568 |
| 2004/0053716 | A1 | 3/2004 | Wu et al. | |
| 2005/0070384 | A1 | 3/2005 | Fitzgerald et al. | |
| 2006/0025251 | A1 * | 2/2006 | Giannetti | A63B 60/00 473/564 |
| 2006/0293129 | A1 | 12/2006 | Kobayashi et al. | |
| 2007/0155546 | A1 | 7/2007 | Chauvin et al. | |
| 2007/0219027 | A1 | 9/2007 | Chong | |
| 2008/0070726 | A1 | 3/2008 | Watari et al. | |
| 2009/0029810 | A1 | 1/2009 | Fitzgerald et al. | |
| 2009/0215560 | A1 | 8/2009 | Mcnamee et al. | |
| 2009/0280934 | A1 | 11/2009 | Watari et al. | |
| 2009/0280935 | A1 | 11/2009 | Watari et al. | |
| 2010/0113194 | A1 | 5/2010 | Tokieda | |
| 2011/0098141 | A1 | 4/2011 | Burger | |
| 2011/0195808 | A1 | 8/2011 | Chauvin et al. | |
| 2012/0108371 | A1 | 5/2012 | Epling et al. | |
| 2014/0080641 | A1 | 3/2014 | Epling et al. | |
| 2014/0080642 | A1 | 3/2014 | Epling et al. | |
| 2014/0272245 | A1 | 9/2014 | Livingston-Peters et al. | |
| 2015/0040349 | A1 | 2/2015 | Malia et al. | |
| 2015/0157908 | A1 | 6/2015 | Zhang et al. | |
| 2017/0340935 | A1 | 11/2017 | Gray et al. | |
| 2019/0143185 | A1 | 5/2019 | Hunt et al. | |
| 2019/0290980 | A1 | 9/2019 | Douglas et al. | |
| 2019/0344140 | A1 | 11/2019 | Chauvin et al. | |

OTHER PUBLICATIONS

U.S. App. No. 15/976,746, filed May 10, 2018, Chauvin, et al.

ASTM International, "F2398-11: Standard Test Method for Measuring Moment of Inertia and Center of Percussion of a Baseball or Softball Bat", edition approved Apr. 1, 2011, published May 2011.

Composites World, "Carbon-Kevlar Hinge, Besting metal hardware in weight, thickness, 3X load capacity and 1 million fatigue cycles", available at https://www.compositesworld.com/blog/post/carbon-kevlar-hinge-. Oct. 30, 2017.

European Space Agency, "Passive Damped Deployment of Full Composite Structures", available at http://www.esa.int/Our_Activities/Space_Engineering_Technology/Shaping_the_Future/Passive_Damped_Deployment_of_Full_Composite_Structures, exact publication date unknown; website visited Feb. 9, 2018.

Grainger, Inc., ""1/2"-14 Brass Hydraulic Coupler Body, 1/2" Body Size"", available at https://www.grainger.com/product/31A959?cm_mmc=PPC:+Google+PLA&s_kwcid=AL!2966!3!50916770997!!!g!82128241917!&ef_id=Wamb7gAAAHQQ3Qhf:20180104235230:s&kwid=productads-adid%5e50916770997-device%5ec-plaid%5e82128241917-sku%5e31A959-adType%5ePLA. Exact publication date unknown, website visited Jan. 23, 2018, 2 pgs.

Russell, Daniel A., "Do Flexible Handle affect the Performance of Baseball or Softball Bats?", Pennsylvania State University, Graduate Program in Acoustics. Exact publication date unknown, last modified Feb. 23, 2007, website visited Jan. 23, 2018, 9 pgs.

Russell, Daniel A., "Explaining the 98-mph BBS standard for ASA softball", Pennsylvania State University, Graduate Program in Acoustics, available at http://www.acs.psu.edu/drussel/bats/bbs-asa.html. Exact publication date unknown, last modified May 12, 2008, website visited Feb. 9, 2018, 6 pgs.

Russell, Daniel A., "Measuring the Vibrational Behavior of a Baseball/Softball Bat", Science & Mathematics Department, Kettering University, Flint, MI, available at http://www.acs.psu.edu/drussell/bats/modal.html, exact publication date unknown, last modified Mar. 17, 2004, website visited Nov. 15, 2017, 3 pgs.

Russell, Daniel A., "Vibrational Modes of a Baseball Bat", Applied Physics, Kettering University, available at http://www.acs.psu.edu/drussell/bats/batvibes.html, exact publication date unknown; website visited Nov. 15, 2017, 4 pgs.

Sharkbite Plumbing Solutions, "Couplings", available at http://www.sharkbite.com/product/couplings/, exact publication date unknown, website visited Jan. 23, 2018.

Tech Briefs, "Locking Mechanism for a Flexible Composite Hinge", available at https://www.techbriefs.com/component/content/article/tb/techbriefs/mechanics-and-machinery/26023. Dec. 1, 2016.

USPTO, "International Search Report and Written Opinion", for PCT/US2011/024224, May 13, 2011.

USPTO, Nonfinal Office Action dated Dec. 5, 2019 for U.S. Appl. No. 15/935,896, 19 pages.

USPTO, Final Office Action dated Nov. 21, 2019 for U.S. Appl. No. 15/976,746, 7 pages.

* cited by examiner

BALL BAT WITH SHOCK ATTENUATING HANDLE

CROSS-REFERENCE TO RELATED APPLICATION

This application is a continuation of U.S. patent application Ser. No. 15/815,423, filed Nov. 16, 2017 and now pending, which is incorporated herein by reference in its entirety.

BACKGROUND

The shock and vibrational characteristics of ball bats have been studied by people in the arts of sports engineering and mechanical engineering. When a ball bat strikes a ball or another object, the impact causes waves of vibration that correspond to various bending modes of the ball bat. Each mode of vibration includes one or more nodes and antinodes. Nodes are generally understood to be the points along the length of the ball bat where the amplitude of a wave in a particular mode is zero. Accordingly, a node corresponds to a location of minimal or zero vibration. An antinode is generally understood to be a point along the length of the ball bat where the amplitude of a wave in a particular mode is at its maximum. Accordingly, an antinode corresponds to a location of maximum shock or vibration. In ball bats, players typically sense vibration according to the first and second bending modes, with the most sensation typically associated with the second bending mode. Vibration and shock in a ball bat can cause a player discomfort or injury.

Some ball bats are made in two or more pieces. Two-piece ball bats are typically constructed by joining a barrel section to a handle section. Existing two-piece ball bats exhibit a small amount of flex between the barrel section and the handle section during impact with a ball. This flex may contribute to an increase in bat speed due to an increased whip effect but may decrease overall performance due to energy lost when the bat flexes. Flex in the interface between the barrel section and the handle section of existing two-piece bats may reduce shock to a user's hands and increase player comfort to some extent, but existing two-piece ball bats do not have optimal shock-attenuating characteristics.

SUMMARY

Representative embodiments of the present technology include a ball bat with a barrel portion, a handle, and a joint connecting the barrel portion to the handle. The joint may include a rod element extending from the handle and into the barrel portion and a filler material in the handle and the barrel portions. The filler material may at least partially surround the rod element within the handle and within the barrel portion. The filler material may span a gap between the barrel portion and the handle. In some embodiments, the filler material is an elastomeric material. In some embodiments, at least one of the barrel portion or the handle is formed with a composite material. In some embodiments, a cover material is positioned around the filler material. The rod element may be tapered in some embodiments. A distal end of the handle may have an inner diameter that is smaller than an outer diameter of the filler material or smaller than an outer diameter of an end of the rod element positioned within the handle. In some embodiments, the joint may be positioned between eight and twelve inches from the proximal end of the bat. In some embodiments, the joint may be positioned at (such as centered about) a vibrational antinode of the bat.

In a further representative embodiment of the present technology, a ball bat may include a first bat portion spaced apart from a second bat portion along a longitudinal axis of the bat and a joint connecting the first bat portion to the second bat portion. The joint may be positioned at or near, or centered about, an antinode of the bat. The joint may include a filler material at least partially surrounding a rod element. The filler material and the rod element may span a gap between the first bat portion and the second bat portion. The filler material may extend into at least one of the first bat portion or the second bat portion.

In a further representative embodiment of the present technology, a ball bat may include a joint connecting two spaced-apart bat portions. The joint may be configured to absorb vibration. The joint may include a rod element at least partially surrounded by a filler material, the rod element and the filler material spanning a gap between the two spaced-apart bat portions to form a structural link between the two spaced-apart bat portions. The joint may be centered about or located near a position of maximum vibration in the bat, such as an antinode.

In a further representative embodiment of the present technology, a ball bat may include a handle formed with composite laminate in which one or more of the layers of composite laminate includes an elastomeric material reinforced with a fiber material.

Ball bats according to embodiments of the present technology provide an enhanced connection between portions of the bat (such as between a barrel portion and the handle) to reduce shock and vibration felt by a player during the bat's impact with a ball.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to ball bats with shock attenuating handles and joints, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball bats and composite materials may not be shown or described in detail so as to avoid unnecessarily obscuring the relevant description of the various embodiments. Accordingly, embodiments of the present technology may include additional elements or exclude some of the elements described below with reference to FIGS. 1-11, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sporting good implements or in other sports or industries involving striking implements.

Figure 1:
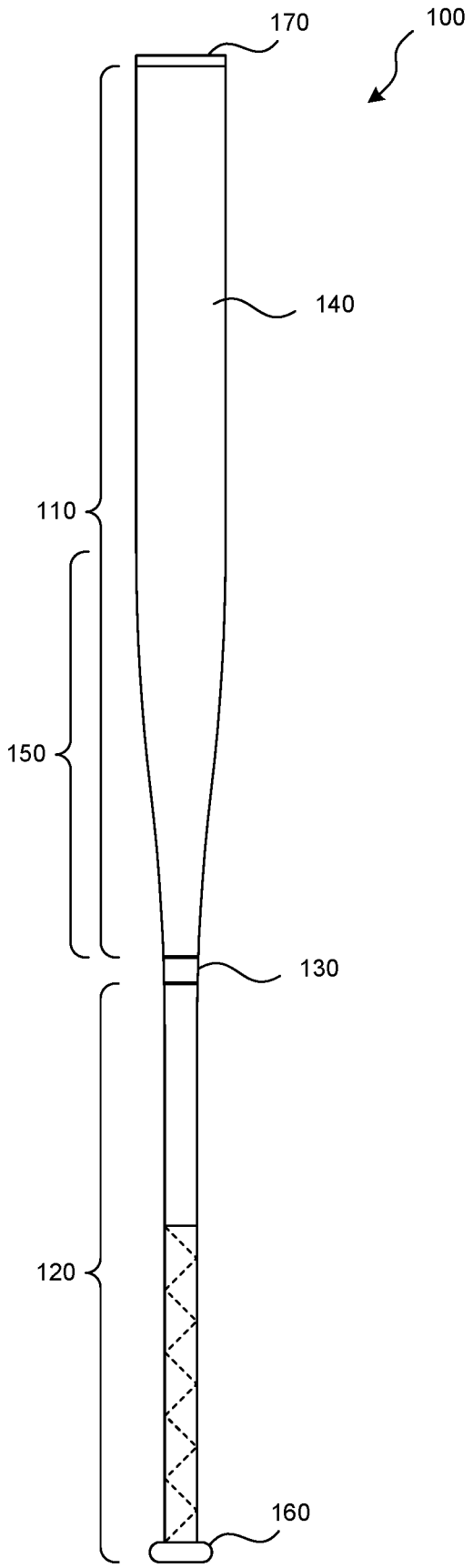
FIG. 1 illustrates a two-piece ball bat having a barrel portion connected to a handle via a shock-attenuating joint according to an embodiment of the present technology.

As shown in FIG. 1, a two-piece ball bat 100 according to an embodiment of the present technology may have a first or barrel portion 110 connected to a second portion or handle 120 via a shock-attenuating joint 130. The barrel portion 110 includes a barrel 140 and a transitional or taper portion 150 in which a larger diameter of the barrel 140 transitions toward a narrower diameter of the joint 130 and the handle 120. The handle 120 may include an end knob 160, and the barrel 140 may optionally be closed at its distal end with an end cap 170.

The bat 100 may have any suitable dimensions. For example, the bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly among users.

Although the bat 100 is described herein as a "two-piece" bat, it is understood that the bat 100 may have more than two pieces. For example, each of the barrel portion 110 and the handle 120 may be formed using multiple pieces, portions, or elements. Moreover, although the joint 130 is illustrated and described as being between the handle 120 and the taper portion 150, in some embodiments of the present technology, the joint 130 may be positioned in the taper portion 150, such that each of the barrel portion 110 and the handle 120 include part of the taper portion 150. In other embodiments, the joint 130 may be located in the handle 120. In some embodiments, the handle 120 may include the taper portion 150, such that the joint 130 is between the taper portion 150 and the barrel 140. As described in additional detail below, the joint 130 may be positioned in other locations along the bat 100.

The barrel portion 110 may be constructed with one or more composite materials. Some examples of suitable composite materials include plies reinforced with fibers of carbon, glass, graphite, boron, aramid (such as Kevlar®), ceramic, or silica (such as Astroquartz®). Accordingly, in various embodiments, a number of different composite plies suitable for use in ball bats may be used, including, for example, composites formed from carbon fiber, fiberglass, aramid fibers, or other composite materials or combinations of matrices, resins, fibers, laminates, and meshes forming composite materials. In some embodiments, the barrel portion 110 may include layers or plies made of the same material (for example, each ply or layer may be formed from carbon fiber), while in further embodiments, the barrel portion 110 may include layers or plies made of multiple different materials (for example, one or more plies or layers may be formed with carbon fiber and one or more other plies or layers may be formed with fiberglass). In some embodiments, the barrel portion 110 may be formed from a metal or metal alloy, such as aluminum, titanium, or another suitable metal.

The handle 120 may be constructed from the same material as, or different materials than, the barrel portion 110. For example, the handle 120 may be constructed from a composite material (the same or a different material than that used to construct the barrel portion 110), a metal material, or any other material suitable for use in a striking implement such as the bat 100.

Figure 2:
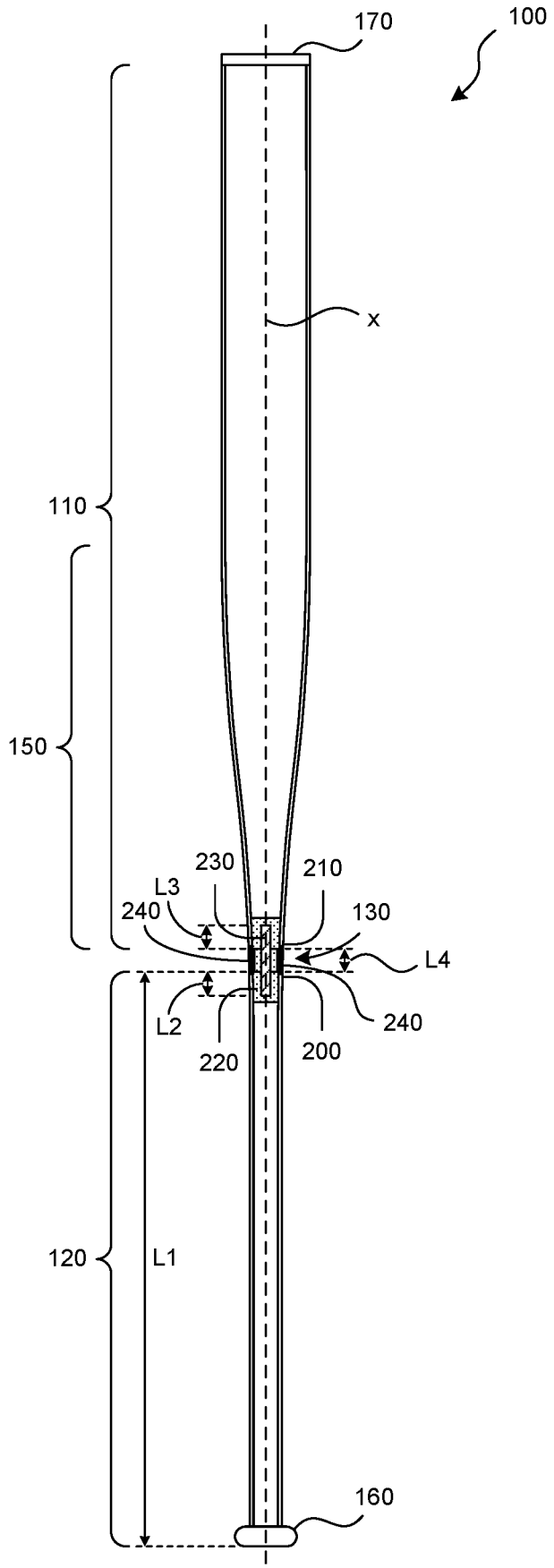
FIG. 2 illustrates a schematic cutaway view of the bat illustrated in FIG. 1, according to an embodiment of the present technology.

FIG. 2 illustrates a schematic cutaway view of the bat 100 illustrated in FIG. 1, according to an embodiment of the present technology. A distal end 200 of the handle 120 is attached to the joint 130. The joint 130 is also attached to a proximal end 210 of the barrel portion 110. Accordingly, in some embodiments of the present technology, the joint 130 is the sole connection between the barrel portion 110 and the handle 120, and the barrel portion 110 and the handle 120 are spaced apart from each other along a longitudinal axis x of the bat 100 (with the joint 130 generally between the barrel portion 110 and the handle 120).

Figure 3:
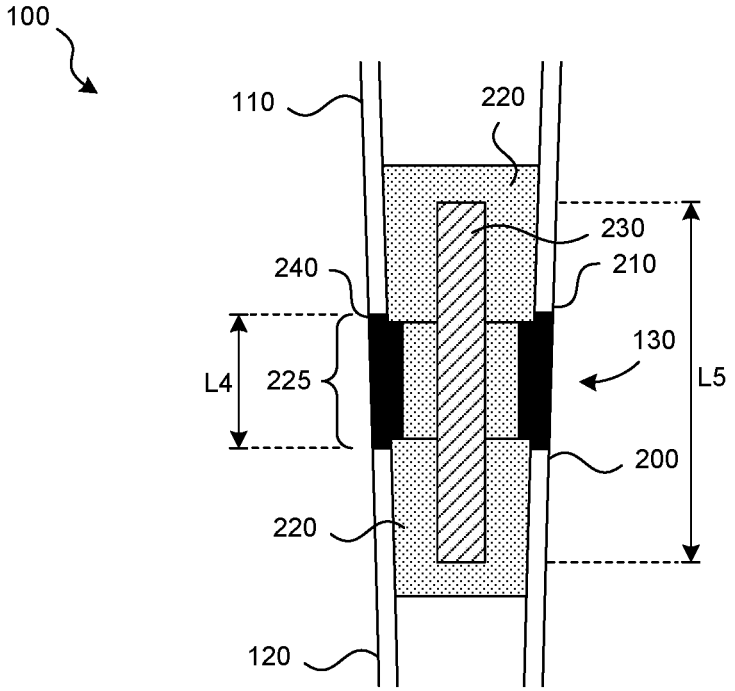
FIGS. 3 and 4 illustrate detailed cross-sectional views of the joint shown in FIG. 2.
Figure 4:
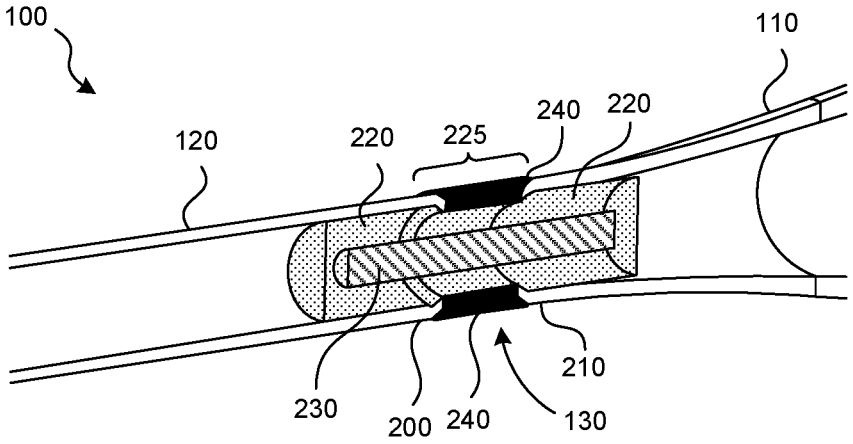

FIGS. 3 and 4 illustrate detailed cross-sectional views of the joint 130 shown in FIG. 2. FIG. 3 illustrates a side cross-sectional view. FIG. 4 illustrates an isometric cross-sectional view. Referring to FIGS. 2-4, the joint 130 includes a filler material 220, which may include an elastomeric material that fills at least part (for example, most or all) of the distal end 200 of the handle 120 and the proximal end 210 of the barrel portion 110. The filler material 220 spans a gap 225 between the barrel portion 110 and the handle 120.

A rod element 230 may be embedded in or surrounded by the filler material 220. The rod element 230 extends from within the distal end 200 of the handle 120 to within the proximal end 210 of the barrel portion 110. In some embodiments, an optional cover layer 240 (of plastic or elastomeric material, for example) may be wrapped around the portion of the filler material 220 of the joint 130 that would otherwise be exposed. In some embodiments, the cover layer 240 fills the remainder of the gap 225 between the barrel portion 110 and the handle 120 that is not otherwise filled with the filler material 220, to provide a smooth outer surface of the bat 100. In some embodiments, the filler material 220 may completely fill the gap 225 between the barrel portion 110 and the handle 120 to provide a smooth outer surface of the bat 100.

The joint 130, which includes the filler material 220, the rod element 230, and any optional cover layer 240, connects the barrel portion 110 to the handle 120 and isolates the handle 120 from the barrel portion 110. The joint 130 absorbs vibration that would otherwise transfer from the barrel portion 110 to the handle 120 after impact with a ball or other object. Accordingly, embodiments of the present technology provide an enhanced connection between the barrel portion and the handle to reduce shock and vibration felt by a player during the bat's impact with a ball.

In some embodiments, the rod element 230 may be cylindrical. In other embodiments, the rod element 230 may have other elongated shapes. For example, it may be oval, triangular, rectangular, or another elongated polygonal shape. A diameter or thickness of the rod element 230 may depend on the sport the bat 100 will be used in, the material forming the rod element 230, and the desired performance characteristics of the bat 100. For example, rod elements according to embodiments of the present technology, such as the rod element 230, may have a diameter or overall thickness between approximately 0.375 inch and 0.5 inch or between approximately 10 millimeters and 12 millimeters. In other embodiments, rod elements such as the rod element 230 may have other suitable shapes or sizes.

In some embodiments, the rod element 230 may be formed from a composite material, such as a pultruded composite material. In other embodiments, the rod 230 may be hollow, such as a polymer or composite tube. In yet further embodiments, the rod 230 may include a wire rope or a twisted wire cable. In yet further embodiments, the rod 230 may be tapered along its length. In general, according to various embodiments of the present technology, the rod element 230 is a flexible damping member that serves as a structural link between the barrel portion 110 and the handle 120.

In some embodiments of the present technology, the filler material 220 may be an elastomeric adhesive. In other embodiments, the filler material 220 may include an elastomer adhered inside a hollow interior of the bat 100. Elastomers and elastomeric materials may include polyurethane, epoxy, acrylic, cyanoacrylate, silicone, or ethylene-vinyl acetate (EVA) foam. In other embodiments, other elastomers or elastomeric materials suitable for providing at least some structural support and at least some resilience may be used. In some embodiments, the filler material 220 may include or be augmented with various materials, such as plastic, resin, glue, hard materials, soft materials, or any material suitable for filling the gap between the barrel portion 110 and the handle 120 while surrounding or holding the rod element 230 in place and transferring forces between the rod element 230 and the remainder of the bat 100.

In some embodiments, the rod element 230 may be relatively rigid and the filler material 220 may be relatively soft. In other embodiments, the rod element 230 may be relatively flexible and the filler material 220 may be sufficiently stiff or resilient to support structural loads of the joint 130. To customize the desired damping and flex characteristics of a bat having a joint 130 according to embodiments of the present technology, one of ordinary skill in the art will understand how to select the flexibility of the rod element 230 vis-à-vis the flexibility of the filler material 220 (such as elastomeric material) to arrive at an overall flexibility or stiffness of the joint 130 to meet the needs of a particular player, sport, or organization. The present technology may enable bat designers to customize the flexibility of a bat (such as flexibility between portions like the handle 120 and the barrel portion 110) via custom selection of materials for the filler material 220, the rod element 230, and any optional cover layer 240. For example, flex between the handle 120 and the barrel portion 110 (or other portions separated by a joint 130) may be tuned to meet a bat designer's desired specifications.

Although joints according to the present technology may be positioned between a handle and a barrel portion, in some embodiments, joints according to the present technology may be located in any suitable position for optimal shock or vibration reduction. For example, in some embodiments, a joint may be positioned to be centered about a vibrational antinode, which is a location along the bat with high vibrational amplitude. Specifically, in some embodiments, a joint may be centered about the vibrational antinode in or near (such as closest to) the handle. In typical bats, vibrational antinodes in the vicinity of the handle may be between eight inches and twelve inches from the proximal end of the bat (at the end of the knob 160). When the joint is centered about a vibrational antinode in or near the handle, player feel is improved because a minimal amount of vibration and shock is transferred from the barrel to the handle upon impact with a ball (as a result of the joint being positioned at a point of high or maximum vibrational amplitude, where the joint can absorb the most vibration).

With reference to FIGS. 2 and 3, in a representative embodiment, a bat having a 33-inch overall length may have a handle 120 with a length L1 of approximately 8 inches. The rod element 230 may extend into the handle 120 by a distance L2 of approximately 2 inches. The rod element 230 may also extend into the barrel portion 110 by a distance L3 of approximately 2 inches. The handle 120 and the barrel portion 110 may be spaced apart by a distance L4 (the length of the gap 225) of approximately 1 inch, separated by (and joined together by) the joint 130. Accordingly, the rod element 230 may have an overall length L5 of approximately 5 inches. Filler material 220 may surround the rod and extend farther into each of the handle 120 and the barrel portion 110 than the rod element 230, or it may have the same length as the rod element 230. In other embodiments, the rod element 230 may extend to a greater or lesser degree into the handle 120 or barrel portion 110, and it may have any other suitable overall length.

In another representative embodiment of a bat according to the present technology, with a 33-inch overall length, the length L1 of the handle 120 may be approximately 11.25 inches. In yet other embodiments, a bat having a 33-inch overall length may have a joint according to the present technology centered about a location that is approximately 13 inches from the end of the bat having the knob 160.

In general, ball bats with various overall lengths may include joints according to the present technology that are centered about a distance from the knob or proximal end of the bat that is between approximately 30% and 50% of the overall length of the bat. For example, a joint may be centered about a distance from the knob end of the bat that is 40% of the total length of the bat. Such a distance generally corresponds with a location of a vibrational antinode.

Figure 5:
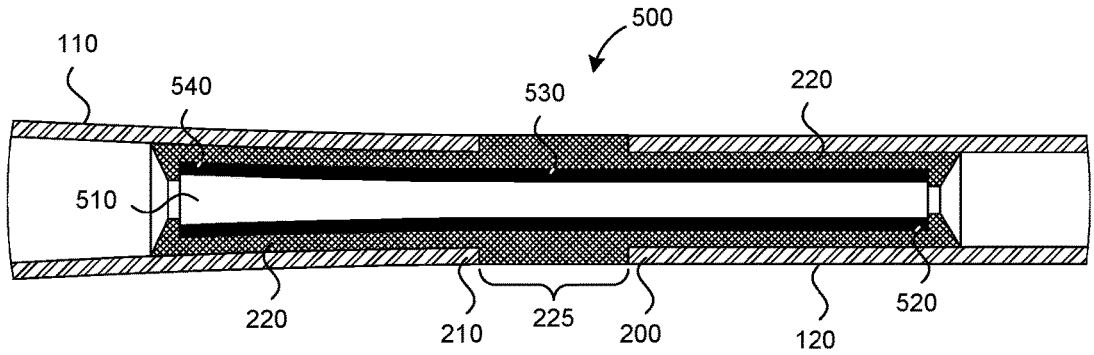
FIG. 5 illustrates a joint according to another embodiment of the present technology.

FIG. 5 illustrates a joint 500 according to another embodiment of the present technology. The joint 500 is generally similar to the joint 130 described and illustrated above with regard to FIGS. 1-4. The joint 500 includes a rod element 510. In some embodiments, the rod element 510 may be tapered along its axial length. For example, the rod element 510 may have a relatively narrow handle end 520 (the end of the rod element 510 inside the handle 120) and a relatively narrow midsection 530 (within the gap 225). A diameter or thickness of the rod element 510 may increase along the length of the rod element 510 to a relatively wider barrel end 540 (the end of the rod element 510 inside the barrel portion 110). The filler material 220 may conform to the shape of the rod element 510. An outer cover layer (not shown) may optionally fill the gap 225.

In some embodiments, the handle end 520 may be wider than the midsection 530. For example, the rod element 510 may be generally symmetrical about the relatively narrow midsection 530. Tapering of the rod element 510 (such as opposing tapers formed by a relatively wider handle end 520 and a relatively wider barrel end 540) may enhance the connection between the barrel portion 110 and the handle 120. Although the rod element 510 is illustrated as being hollow in FIG. 5, it may not be hollow in some embodiments, or it may have other suitable configurations.

Figure 6:
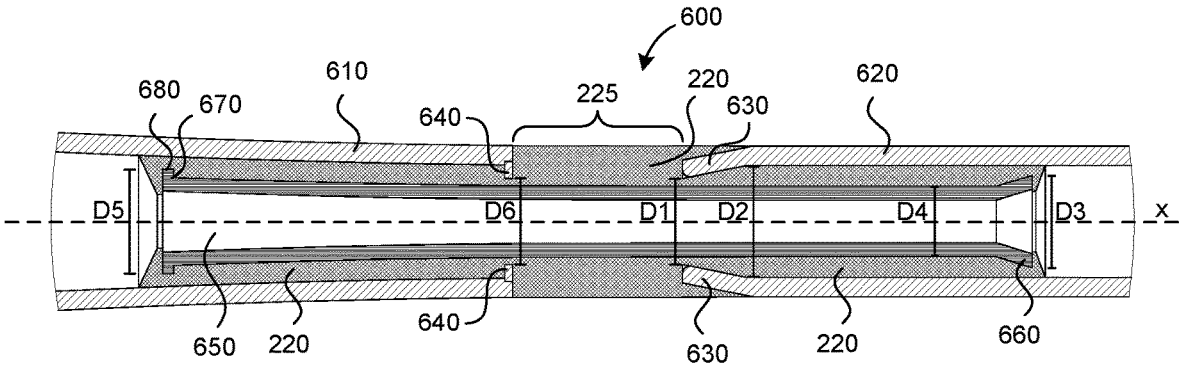
FIG. 6 illustrates a joint according to another embodiment of the present technology.

FIG. 6 illustrates a joint 600 according to another embodiment of the present technology. The joint 600 is generally similar to the joint 130 described and illustrated above with regard to FIGS. 1-4. In some embodiments, the joint 600 includes a number of tapered features to further increase reliability of the connection between the barrel portion 610 and the handle 620. For example, in some embodiments, a distal end 630 of the handle 620 may bend or taper inwardly toward the longitudinal axis x of the bat, such that it has an inner diameter D1 that is less than an outer diameter D2 of the elastomeric material 220 within the handle 620. Such a taper engages the filler material 220 to resist separation of the filler material 220 from the handle 620. In some embodiments, the barrel portion 610 may include a lip 640 extending generally radially inwardly from the barrel portion 610. The lip 640 helps hold the filler material 220 relative to the barrel portion 610.

In some embodiments, the rod element 650 may include a tapered handle end 660 (positioned within the handle 620) that has an outer diameter D3 that is larger than an inner diameter D4 of the filler material 220. Such a taper helps the filler material 220 engage the rod element 650 for a secure connection. In some embodiments, the outer diameter D3 of the tapered handle end 660 of the rod element 650 may also be larger than the inner diameter D1 of the distal end 630 of the handle 620. Accordingly, if the filler material 220 fails, the rod element 650 remains retained inside the handle 620 to prevent total separation of the barrel portion 610 from the handle 620.

In some embodiments, the barrel end 670 of the rod element 650 may have a similar taper as the handle end 660, and the proximal end of the barrel portion 610 may have a similar taper as the distal end 630 of the handle 620. In other embodiments, the barrel end 670 may include a lip 680 that protrudes into the filler material 220 to help engage the filler material 220 to provide a secure connection. In some embodiments, the lip 680 on the barrel end 670 may have an outer diameter D5 that is larger than an inner diameter D6 of the lip 640 on the barrel portion 610 to prevent the rod element 650 from being removed from the barrel portion 610, thus preventing total separation of the barrel portion 610 from the handle 620. The filler material 220 may partially or completely fill the space between the rod element 650 and the barrel portion 610, the space between the rod element 650 and the handle 620, and the gap 225 between the barrel portion 610 and the handle 620. Although the embodiment illustrated in FIG. 6 includes a lip 680 and a tapered handle end 660, in some embodiments, the rod element 650 may include two lips (one on each end) or two tapered ends (one on each end), or any suitable combination of lips and tapered ends, or any other projections suitable for keeping the rod element 650 in the handle 620 or the barrel portion 610 even if the filler material 220 fails. An outer cover layer may optionally fill or cover the gap 225.

Figure 7:
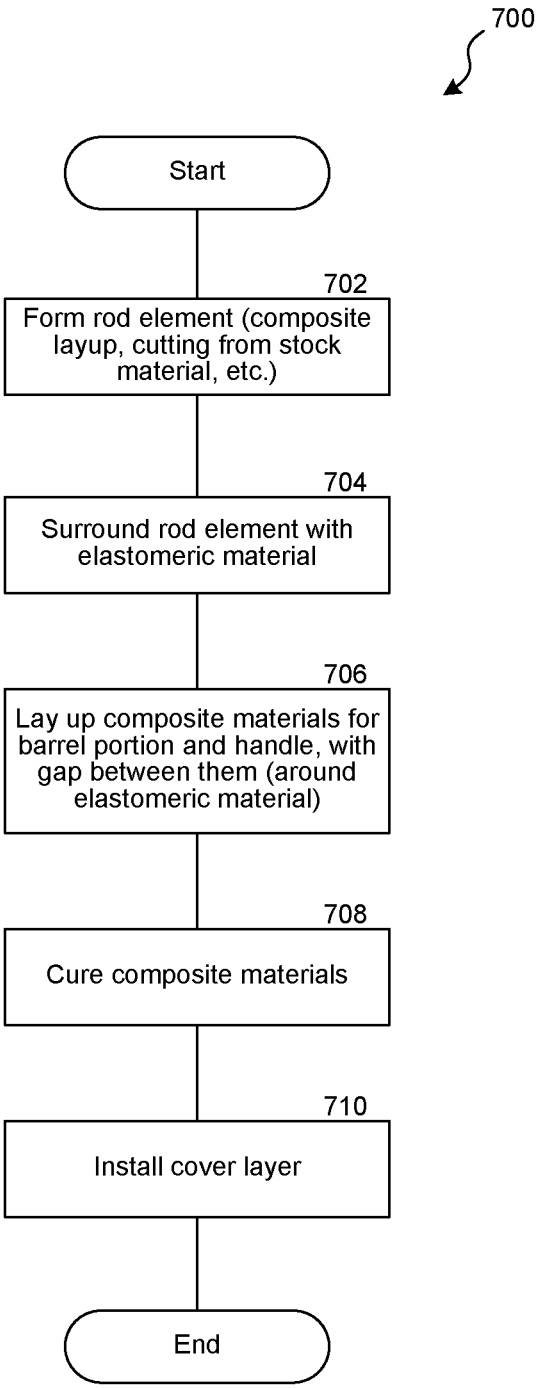
FIG. 7 illustrates a flowchart of a method of manufacturing a ball bat according to an embodiment of the present technology.

FIG. 7 illustrates a flowchart 700 of a method of manufacturing a ball bat according to an embodiment of the present technology. In block 702, a manufacturer may form the rod element using various techniques, such as composite manufacturing or cutting from a stock material, or other suitable techniques for forming a suitable rod element according to embodiments of the technology. In block 704, a manufacturer may wrap, coat, or otherwise surround the rod element with elastomeric material. In block 706, a manufacturer may lay up or otherwise arrange the composite materials for the barrel portion and the handle, leaving a gap between the barrel portion and the handle that is at least partially filled by the assembly formed in block 704. The composite materials may be arranged by laying up plies or layers (such as wet layup materials or pre-preg composite materials) in a mold or by arranging materials in a resin transfer molding (RTM) process. In block 708, the composite materials may be cured. In block 710, a cover layer may be positioned in the gap around the elastomeric material or over the gap. The foregoing method may be modified in other embodiments. For example, steps of the method may be performed in other suitable sequences.

In some embodiments, the rod element may be cured before the barrel portion and handle are cured. In other embodiments, the rod element may be cured simultaneously with the barrel portion and the handle. In other embodiments, a manufacturer may make an entire bat (using composites or metals, for example), cut the bat, and then connect the pieces (such as a barrel portion and a handle) together using joints according to embodiments of the present technology. In some embodiments, various elements (such as the rod element, the handle, or the barrel portion, or other portions) may be formed from pre-cured composite material such that they do not need to be cured in the process illustrated in FIG. 7, or they may be formed from non-composite or other suitable materials.

In a particular representative non-limiting embodiment of the present technology, stiffness of the rod element may be measured in a 3-point bending test. For example, a sample material may be positioned on two supporting contact points spaced apart by approximately six inches. The contact points may be the rounded sides of pins having a diameter of one inch. A force may be applied to specimen between the contact points. The force may be applied by a contact point that has the same geometry as the two supporting contact points. For example, the force may be applied with the side of a pin having a diameter of one inch. The force may be applied to the specimen directly in the middle of the two contact points until a desired deflection in the specimen occurs, such as 0.1 inches. The force at which the deflection occurs may be used to define the stiffness of the rod element 230. For example, the stiffness of various straight rod elements or hollow rod elements having diameters between approximately 0.375 inches and approximately 0.5 inches may range between approximately 270 lb/in and 1690 lb/in. In some embodiments, a rod element may be a tapered composite tube having a diameter of 0.375 inches on one end and a diameter of 1.375 inches on the other end, and it may have a stiffness value between 1190 lb/in and 7920 lb/in when measured in the above manner. Details of the manner of testing may affect test results according to various embodiments of the present technology.

In another particular representative embodiment of the present technology, stiffness of an overall bat 100 may be measured using a cantilevered bending test in which a bat (having a handle connected to a barrel portion using a joint) is held rigidly near one end (such as six inches from the end having the knob). A downward force may be applied at approximately one inch from the farthest end of the barrel using a contact point similar to the contact point described above. The inventors tested various joints having a variety of combinations of rod elements and filler materials, deflecting the bats between 0.1 inch and 1 inch.

In general, in a cantilevered test such as the one described in the foregoing paragraph, the overall stiffness of a bat and its maximum bending moment location will vary based on several factors, such as the stiffness of each of the handle, the barrel portion, the rod element, and the filler material. Accordingly, some bats may have similar overall stiffness despite having different combinations of components. In a particular representative embodiment of the present technology in which the handle, barrel portion, rod element, and filler material were all relatively flexible, the bat assembly had an overall stiffness of approximately 11 lb/in. In another representative embodiment in which the handle and barrel portion were each relatively rigid, but the rod element and filler material were relatively flexible, the overall stiffness was approximately 12 lb/in. Although overall stiffness between two bats may be similar, and although different configurations may have a maximum bending moment located in a similar location in the bat, such two bats may still have a different feel to a player. In yet another further particular embodiment having a very rigid handle and barrel portion and a very rigid rod element, but a relatively flexible filler material, stiffness of the overall bat may be between approximately 18 lb/in and 36 lb/in. The foregoing specific values are meant to be exemplary only and do not limit the scope of the present technology.

FIGS. 8-11 illustrate cross-sectional views of portions of multiple-piece ball bats according to further embodiments of the present technology in which a rod element may extend approximately the length of a handle portion of a ball bat, or it may form all or part of the handle portion of a ball bat. For example, a ball bat 800 may include a barrel portion 810 connected to a handle 820 by a joint 830. The barrel portion 810 may include all or part of a transitional or taper portion in which a larger diameter of a barrel in the barrel portion 810 transitions toward a narrower diameter of the handle 820, as described above in the context of other embodiments. The handle 820 may extend into and be constrained by the barrel portion 810. The handle 820 may have an outer diameter or flared portion 840 which prevents the handle 820 from being pulled out of a narrower diameter or converging portion 850 of the barrel portion 810.

In some embodiments, the handle 820 may be similar to the rod elements described above. In some embodiments, the handle 820 may be connected to the barrel portion 810 with a filler material 860 between the barrel portion 810 and the handle 820. The filler material 860 may include an elastomeric material and it may be similar to the filler material described above with regard to FIGS. 2-7. In some embodiments, the handle 820 may include a plurality of layers of composite laminate materials.

In a particular embodiment of the present technology, one or more of the layers of composite laminate materials in the handle 820 may include a resilient or elastomeric layer 870, which may include an elastomeric material reinforced with fibers such as glass fibers, carbon fibers, aramid fibers, or thermoplastic fibers, such as nylon or polyethylene fibers (for example, Spectra® or Dyneema®). In other embodiments, other reinforcing fibers or reinforcing elements may be used. The elastomeric material and the reinforcing fibers forming the elastomeric layer 870 may be selected to tune the stiffness of the handle 820 to reduce vibration in the handle 820. In some embodiments, the elastomeric layer 870 may not include fibers or other reinforcing elements. For example, in some embodiments, the elastomeric layer 870 may include merely an elastomeric material or a combination of elastomeric materials.

Figure 8:
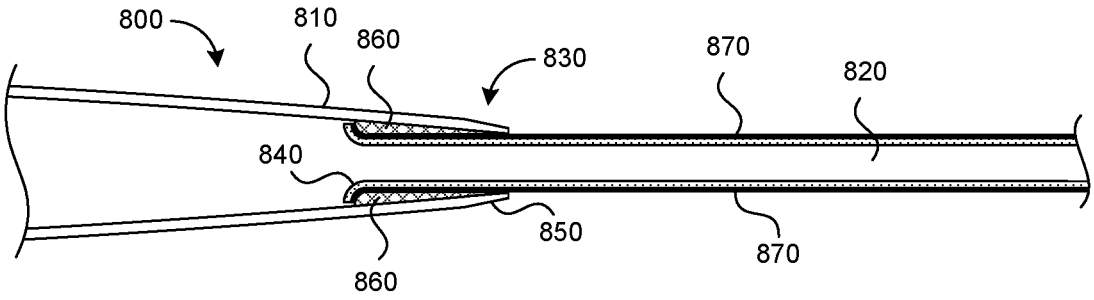
FIGS. 8-11 illustrate cross-sectional views of portions of multiple-piece ball bats according to other embodiments of the present technology.

In some embodiments, the elastomeric layer 870 may have a thickness between approximately 0.004 inches and 0.125 inches. The elastomeric layer may have a hardness value ranging between approximately 65 Shore A and 75 Shore D. In a particular representative embodiment, as illustrated in FIG. 8, the elastomeric layer 870 may be the outermost layer of the composite laminate forming the handle 820. In another embodiment (not illustrated), the elastomeric layer 870 may be the innermost layer of the composite laminate forming the handle 820. In some embodiments, the elastomeric layer 870 may generally span a full length of the handle 820 (including, optionally, all or part of a knob, such as the knob 160 illustrated in FIG. 1). In some embodiments, the handle 820 may include multiple elastomeric layers distributed throughout the composite laminate layup forming the handle 820.

Figure 9:
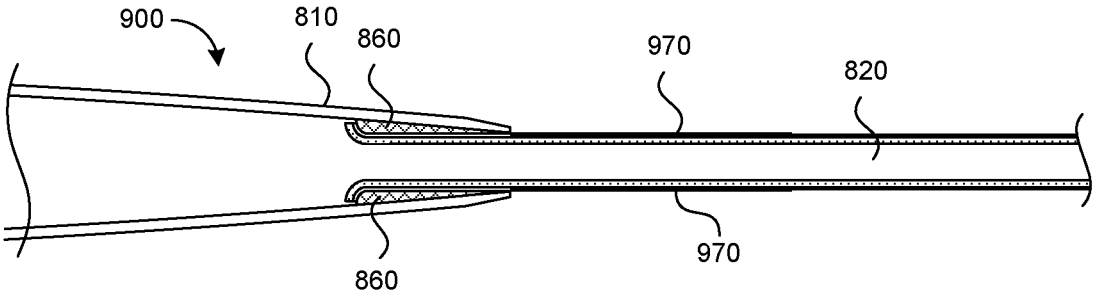

In another embodiment, as generally illustrated in FIG. 9, a ball bat 900 may be generally similar to the ball bat 800 illustrated in FIG. 8, but the elastomeric layer 970 may extend only along a portion of the handle 820. For example, the elastomeric layer 970 may extend between an end of the barrel portion 810 and a middle portion of the handle 820 (for example, not all the way to a knob on the handle 820).

Figure 10:
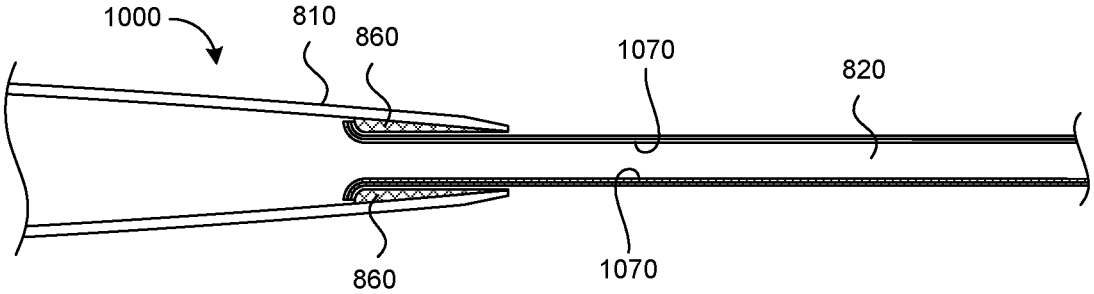

FIG. 10 illustrates a ball bat 1000 according to another embodiment of the present technology, in which the elastomeric layer 1070 (which may be similar to the elastomeric layers 870, 970 described above) is an interior layer within the composite laminate layup of forming the handle 820. For example, the elastomeric layer 1070 may be sandwiched between other composite laminate layers (such as traditional rigid or semi-rigid composite laminate layers). The elastomeric layer 1070 may span all or a part of the length of the handle 820.

Figure 11:
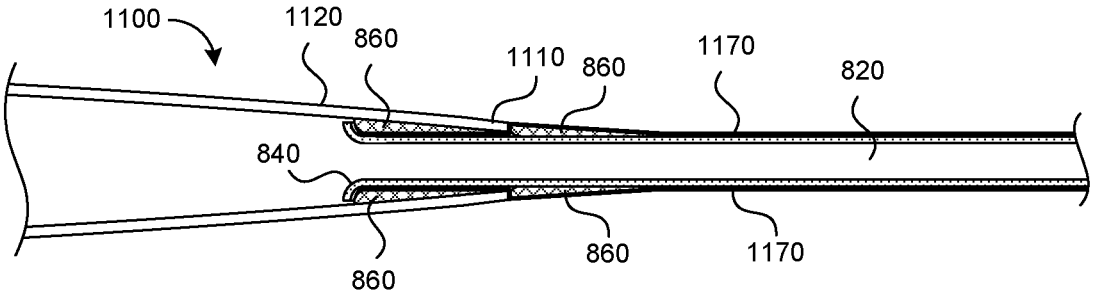

FIG. 11 illustrates a ball bat 1100 according to another embodiment of the present technology. The ball bat 1100 may be generally similar to the ball bat 800 described above with regard to FIG. 8, but it may further include additional filler material 860 positioned on the handle 820 adjacent to a proximal end 1110 of the barrel portion 1120. The additional layer of filler material 860 may be positioned underneath an elastomeric layer 1170, which may be similar to the elastomeric layer 870 described above with regard to FIG. 8 and may extend all or a part of the length of the handle 820. The filler material 860 adjacent to the proximal end 1110 of the barrel portion 1120 may provide shape and support for the transitional or taper region of the bat between the diameters of the barrel and the handle. Accordingly, the elastomeric layer 1170 may span all or part of the transitional or taper region.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in some embodiments, the barrel portion, the handle, or both the barrel portion and the handle may be attached to the rod element with one or more pins passing transversely into or through the constituent parts to enhance the connection. In some embodiments, the filler materials 220, 860 (which may include elastomeric materials as described in detail above) may be formed from a single type of material. However, in further embodiments, the filler materials 220, 860 may be formed by two or more layers of different filler or elastomeric materials (such as 3 layers, or another suitable number of layers). For example, in some embodiments, a layer of filler material closer to the longitudinal axis x of a bat (in other words, a radially inward layer) may include a different material or may have a different hardness, stiffness, density, or other characteristic than a layer of filler material farther from the longitudinal axis x of the bat (a radially outward layer). In a particular representative embodiment, a radially outward layer of filler material 220, 860 may include a material having higher density relative to the density of a radially inward layer of filler material 220, 860.

With regard to FIGS. 8-11, a knob element (such as a knob 160 shown in FIGS. 1 and 2) may be integral with or attached to the handle 820. The elastomeric layer (such as the elastomeric layers 870, 970, 1070, and 1170 described above) may be an integral layer within the composite layup of the bat handle or it may be positioned around one or more parts of the bat after the remainder of the bat is made or assembled. Elastomeric layers may be attached as single layers or as separate spaced-apart segments.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat comprising:

a barrel portion having a distal end and a proximal end opposite the distal end, wherein the proximal end has a converging portion;

a handle extending into the barrel portion, wherein the handle comprises a flared portion positioned in the converging portion to resist removal of the handle from the barrel portion; and a filler material positioned in the converging portion between the barrel portion and the handle, wherein the filler material, the converging portion, and the flared portion comprise at least part of a joint connecting the barrel portion to the handle;

wherein the handle comprises both:

(a) at least one layer of elastomeric material, wherein the at least one layer of elastomeric material comprises reinforcing fibers; and (b) a plurality of layers of composite laminate material.

2. The ball bat of claim 1 wherein the filler material comprises an elastomeric material.

3. The ball bat of claim 1 wherein the barrel portion is formed with a metal material.

4. The ball bat of claim 1 wherein the at least one layer of elastomeric material is an outermost layer of the handle.

5. The ball bat of claim 1 wherein the at least one layer of elastomeric material is an innermost layer of the handle.

6. The ball bat of claim 1 wherein the at least one layer of elastomeric material extends into the converging portion.

7. The ball bat of claim 6 wherein the handle comprises a knob, and wherein the at least one layer of elastomeric material extends to the knob.

8. The ball bat of claim 1 wherein the handle comprises a knob, and wherein the at least one layer of elastomeric material extends along only a portion of the handle between the converging portion and the knob.

9. The ball bat of claim 1 wherein the at least one layer of elastomeric material is positioned between two or more of the layers of composite laminate material.

10. The ball bat of claim 1, further comprising an additional filler material positioned on the handle outside of the converging portion and adjacent to the proximal end of the barrel portion.

11. A ball bat comprising:

a handle comprising a plurality of layers of composite laminate material, wherein one or more layers of elastomeric material is positioned between two or more of the layers of composite laminate material, wherein the one or more layers of elastomeric material include reinforcing fibers, and wherein the handle includes an end knob positioned on a proximal end of the handle; and a barrel portion having a barrel with a first diameter and a converging portion that tapers from the first diameter to a second diameter smaller than the first diameter; wherein the handle includes a flared end portion positioned in the converging portion of the barrel; and the ball bat further comprises an elastomeric filler material positioned in the converging portion between the flared end portion and the converging portion to connect the handle to the barrel portion.

12. The ball bat of claim 11, further comprising an additional elastomeric material positioned on the handle, outside of the converging portion, and adjacent to the converging portion to provide a tapered shape transitioning the barrel portion to the handle.

13. A ball bat comprising:

a barrel portion having a converging portion;

a handle having a first end with a knob and a second end with a flared portion, the second end extending into the converging portion, the flared portion being constrained by the converging portion and being configured to resist removal of the handle from the barrel portion; and a filler material joining the barrel portion to the handle;

wherein the handle comprises both:

(a) one or more layers of elastomeric material, wherein the one or more layers of elastomeric material are reinforced with reinforcing fibers, and wherein the one or more layers of elastomeric material extend from within the converging portion and along a portion of a length of the handle outside of the converging portion; and (b) a plurality of layers of composite laminate materials.

14. The ball bat of claim 13 wherein the filler material is an elastomeric material.

15. The ball bat of claim 13 wherein the one or more layers of elastomeric material do not extend to the knob.

* * * * *